US005465453A

United States Patent [19]

Landmeier

[11] Patent Number: 5,465,453

[45] Date of Patent: Nov. 14, 1995

[54] PAINT BRUSH PROTECTIVE COVER

[76] Inventor: Robert F. Landmeier, #2 Undine Dr., Thonotassasa, Fla. 33592

[21] Appl. No.: 273,310

[22] Filed: Jul. 11, 1994

[51] Int. Cl.[6] ..... B65D 75/14

[52] U.S. Cl. ..... 15/247; 206/361; 206/362.4

[58] Field of Search ..... 15/247, 184; 206/361, 206/362.4

[56] References Cited

U.S. PATENT DOCUMENTS

| | | | |
|---|---|---|---|
| 224,913 | 2/1880 | Hollwede | 15/247 |
| 1,938,442 | 12/1933 | Stuart | 15/247 |
| 2,506,954 | 5/1950 | First | 206/362.4 |
| 2,609,920 | 9/1952 | Ringler | 206/362.4 |
| 3,077,978 | 2/1963 | Krzyzanowski et al. | 206/362.4 |
| 3,981,399 | 9/1976 | Crouch | 206/362.4 X |

*Primary Examiner*—Chris K. Moore

[57] ABSTRACT

A paint brush protective cover for protecting the bristles of a paint brush comprising a flexible cover and a hard cover. The flexible cover further comprising a plurality of flaps that are wrapped around the bristles of the paint brush and secured together. The flexible cover further comprising a plurality of vent openings and a handle opening to allow a paint brush handle to be inserted therein. After the flexible cover is installed over the bristles of the paint brush, a hard cover is slipped over the flexible cover and locked in place by a top lid to complete the task.

7 Claims, 3 Drawing Sheets

PAINT BRUSH PROTECTIVE COVER

BACKGROUND OF INVENTION

This invention relates to a apparatus used in the field of commercial painting. More specifically, this invention is an improved paint brush protective cover that protects the bristles of paint brushes from being damaged during storage or nonuse thereby extending the life of the paint brush.

Many professional painters today use high quality paint brushes with substantial costs. Thus, painters must take care of their expensive brushes to prolong their life and to reduce the costs of maintaining their equipment. When a paint brush has been used, the painter must clean the brush in an appropriate solution to remove all of the existing paint. After the brush has been cleaned, sometimes the bristles tend to separate and fray off in nonuniform directions. This becomes a problem when the painter needs to use the brush again land the edges of the brush are not uniformly aligned. When the painter tries to paint on tight corners or to get an even distribution of paint onto a surface, the out of aligned bristles tend to scatter the paint and produce substandard results. If the bristles are aligned properly, the painter has control over the paint when painting around tight corners and can obtain an even distribution of paint onto a surface. This problem has been solved by the invention whereby the flexible cover is snugly wrapped around the bristles of the paint brush storing the bristles in a aligned fashion.

It has been customary for painters to clean their paint brushes with a cleaning solution after painting, and to store their brushes in the covers that the brushes were sold in or with no cover at all. If no protective covers are used, dust and other particles can stick and become imbedded inside the bristles, thus when the brush is used to paint again, these particles will collect on the paint producing a nonuniform streaks of paint during use.

Several approaches have been provide for, in Palthe of U.S. Pat. No. 4,018,240, "A device for use in thoroughly cleaning wet paint or varnish from a brush through the application of a cleaning solvent. The device includes a pump for pumping the solvent through a plurality of nozzles. The nozzles are adapted to be positioned between the bristles at the heel of a brush to be cleaned, with end portions of the nozzles in an opening between the bristles adjacent a divider wedge around which the bristles are fastened. Such positioning orients outlet openings adjacent the ends of the nozzles to direct solvent pumped through the nozzles transversely outwardly through the bristles to thoroughly clean the bristles at the heel of the brush." While this device has its advantages, it does not take into account the care for the paint brush after it has been cleaned. Once the brush has been cleaned, it is still subjected to contamination from dust, dirt, and a plurality of other sources.

Another approach is taught by Conley in U.S. Pat. No. 4,641,673 wherein "Both pant rollers and paint brushes may be cleaned of water base paints within this apparatus which comprises an open ended tubular housing which contains a water manifold which produces a series of water jets which are aligned with the elongated axis of the housing and which impact either the paint roller or the paintbrush in a slightly offset fashion so as to impart a spin thereto. An adjustable clamping means is located on the outside of the housing on the side, opposite the location of the water manifold which adapts to a variety of different configurations of paint roller holder rods in order that the paint roller itself may be properly disposed within the interior of the housing such that the axis of the roller aligns with the axis of the housing. The water jets then impact off-center on the pile of the paint roller, washing out the paint, and imparting a spin to the roller which throws off the diluted paint and the wash water. Paint brushes are cleaned in the apparatus by employing an additional element, a brush holder, which fits into one of the open ends of the housing. The brush holder acts to align the brush along the axis of the housing and in the path of the water jets. Additionally, the paintbrush cleaning apparatus desirably includes a second series of water jets which emanate from a second water manifold which connects to the distal end of the water manifold discussed above, such that the second series of water jets is directed upwardly parallel to the bristles of the paintbrush to deeply cleanse therewithin." Similarly, as in the art of Palte, this device does nothing to protect the bristles once the paint brush has been cleaned.

SUMMARY OF THE INVENTION

Accordingly, it is an object of this invention to protect the bristles of a paint brush from contaminants after a paint brush has been cleaned for storage.

Another object of this invention is to provide a flexible covering that will fold around the bristles of a paint brush and be secured.

Still another object of this invention is to provide a plurality of vent openings in the flexible cover that will allow the bristles of the paint brush to breath during storage.

Still yet another object of this invention is to provide a removeably affixing means that will hold and secure the flexible cover around the bristles of the paint brush and keep the bristles in an aligned fashion.

A further object of this invention is to provide a hard protective cover to fit over the paint brush and the flexible cover to keep the bristles from being bent during storage.

Another object of this invention is to provide flexible cover with a handle opening to allow a handle of a paint brush to be inserted therein.

Still another object of this invention is to provide a hard cover with a handle opening to allow the handle of a paint brush to be inserted therein.

Still yet another object of this invention is to provide a hard cover with a window to allow the user to indentify what type of brush is inside.

In carrying out this invention in the illustrative embodiment thereof, an improved paint brush protective cover is used to protect the bristles of a paint brush during storage.

Conveniently, the user may insert the handle of the paint brush into the handle opening in the flexible cover. Next the user folds both sides of the protective cover over the front of the paint brush, folds the bottom flap over the side flaps, whereby the securing means is exposed, and folds the top flap onto the bottom flap whereby the securing means are joined together. The user then fully inserts the paint brush handle into the handle opening of the hard cover whereby the bristles and the flexible cover are totally enclosed. To complete the task, the top lid of the hard cover is closed to lock the bristles of the paint brush inside.

BRIEF DESCRIPTION OF THE DRAWINGS

This invention, together with other objects, features, aspects and advantages thereof, will be more clearly understood from the following description, considered in conjunction with the accompanying drawings.

Three sheets of drawings are furnished, sheet one contains FIG. 1 , an orthographic view of the invention comprising a hard cover enclosing a soft, flexible cover enclosing the bristles of a paint brush.

Figure 2:
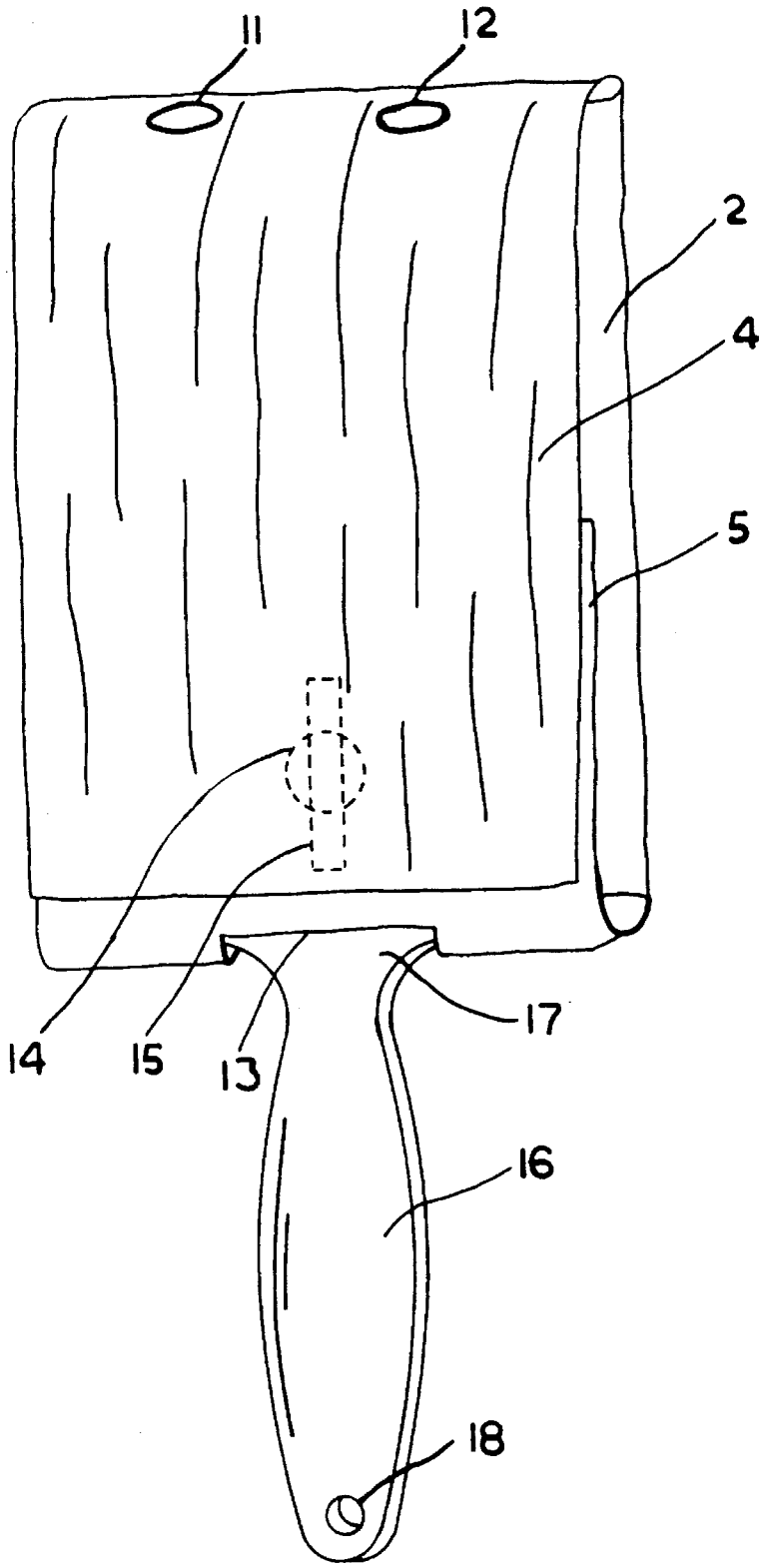

Sheet two contains FIG. 2, an orthographic view of the paint brush with only the flexible cover enclosing the bristle portion of the brush.

Figure 3:
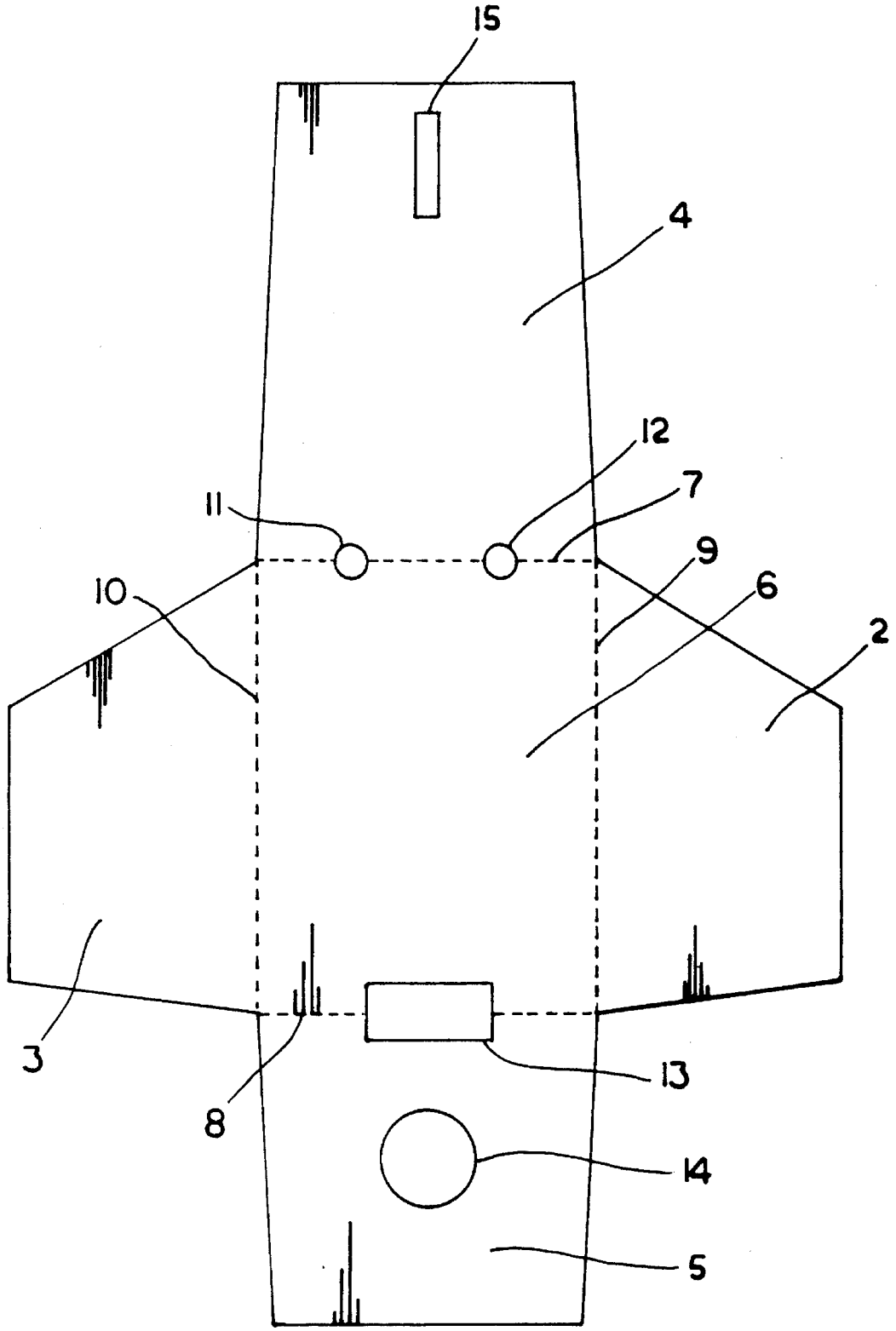

Sheet three contains FIG. 3, a top view of the flexible cover in a fully unfolded position showing the side flaps, the top flap, the bottom flap, the removeable affixing means, the vent openings, the handle opening and a plurality of folding lines.

DESCRIPTION OF THE PREFERRED EMBODIMENTS

Figure 1:
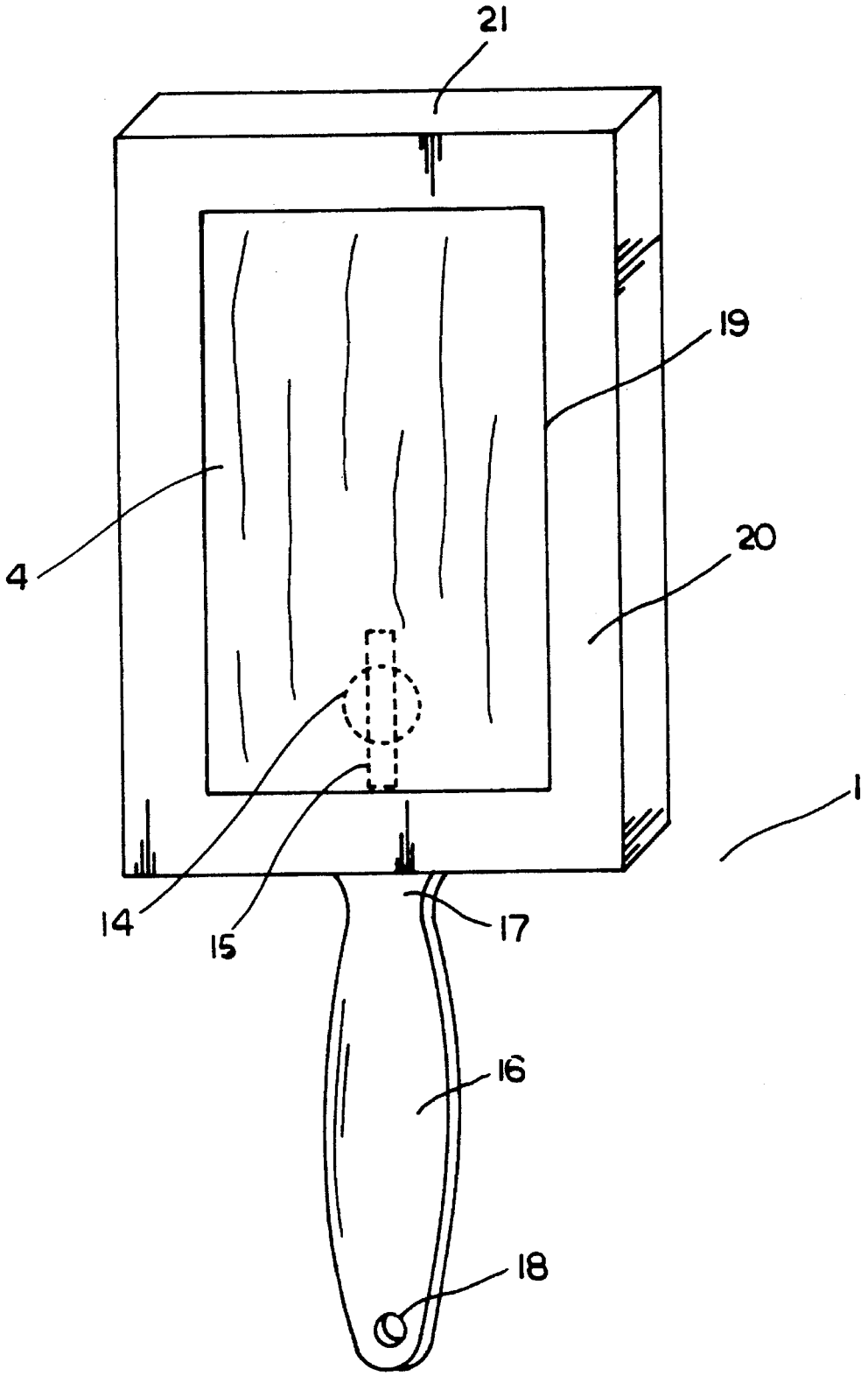

Referring to FIG. 1, an improved protective covering for paint brushes referred to generally by the reference numeral 1. FIG. 1 shows the paint brush handle 16 with an opening 18 therethrough and a neck portion of the handle 17. The bristle portion of the paint brush is enclose by a flexible cover, the top flap 4 of the flexible cover viewable through a window 19 of a hard protective cover 20. The top lid 21 of the hard protective cover 20 is in a closed position. The removeable affixing means of the flexible cover is shown by dotted lines 14 and 15.

Referring now to FIG. 2, we see the paint brush enclosed by only the flexible protective cover. The paint brush handle 16 with an opening 18 therethrough and a neck portion of the handle 17 being show at the bottom portion of the Figure. The neck 17 portion of the paint brush handle being fully inserted through a handle opening 13 in the flexible cover. The removeable affixing means of the flexible cover is shown by dotted lines 14 and 15. The vent holes 11 and 12 are viewable at the top portion of the paint brush. The flexible cover having side flap 2, top flap 4 and bottom flap 5 being shown in the Figure.

Referring now to FIG. 3, we see a top view of the flexible cover in a fully unfolded position. The flexible cover comprising vent holes 11 and 12 to allow ventilation of the bristles during storage. The flexible cover comprising five major parts with a top flap 4, a bottom flap 5, a pair of side flaps 2 and 3, and a back area 6. Affixed to the top flap 4 is a removable affixing means 15 and affixed to the bottom flap 5 is another removeable affixing means 14 such that when the top flap 4 and the bottom flap 5 are folded together, the removeable affixing means 14 and 15 are abutted together. A handle opening 13 is cut through the flexible cover to allow the handle of a paint brush to pass through. The flexible cover displaying dotted lines 7, 8, 9, and 10 to show the general location where the flexible cover is to be folded.

Accordingly, a very unique, attractive, convenient apparatus are provided for protecting the bristles of a paint brush during storage.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. An improved paint brush protective cover for protecting a plurality of bristles of a paint brush, the improved paint brush protective cover comprising:

(a) a flexible cover comprising:

(a) a back cover, substantially rectangular, having a given thickness, a top side, a bottom side, two lateral sides; and, (b) a pair of side flaps affixed to said lateral sides of said back cover; and, (c) a top flap affixed to said top side of said back cover; and, (d) a bottom flap affixed to said bottom side of said back cover; and, (e) a handle opening at said bottom side of said back cover having a given area; and, (f) at least one vent opening at said top side of said back cover; and, (g) a removeable affixing means affixed to said top flap; and, (h) a removeable affixing means affixed to said bottom flap, (b) a hard cover enclosing said flexible cover, said hard cover having a substantially rectangular body, with a given length, a given width, a given thickness, whereby said flaps of said flexible cover are wrapped around said bristles of said paint brush and affixed by said removeable affixing means, whereby said paint brush and said flexible cover are inserted into said hard cover for storage.

2. An improved paint brush protective cover as set forth in claim 1 wherein said hard cover having a window to allow the user to identify the type of paint brush enclosed therein.

3. An improved paint brush protective cover as set forth in claim 1 wherein said hard cover having a top lid to allow said bristles portion of said paint brush to be inserted therein.

4. An improved paint brush protective cover as set forth in claim 1 wherein said removeable affixing means having a given surface area to adjust for different size paint brushes when said top and bottom flaps are brought together.

5. An improved paint brush protective cover as set forth in claim 1 wherein said vent opening having a given area to allow the passage of air to flow into said bristles of said paint brush.

6. An improved paint brush protective cover as set forth in claim 1 wherein said handle opening having a given area large enough to allow a paint brush handle to be inserted therein.

7. An improved paint brush protective cover as set forth in claim 1 wherein said hard cover having a handle opening with a given area large enough to allow a paint brush handle to be inserted therein.

* * * * *